US005295275A

United States Patent [19]

Sherman

[11] Patent Number: 5,295,275

[45] Date of Patent: Mar. 22, 1994

[54] CONVERTIBLE SOFA BED SYSTEM

[76] Inventor: Ronald K. Sherman, 941 Crystal Lake, #305, Pompano Beach, Fla. 33064

[21] Appl. No.: 702,910

[22] Filed: May 20, 1991

Related U.S. Application Data

[63] Continuation-in-part of Ser. No. 464,138, Jan. 16, 1990, abandoned.

[51] Int. Cl.[5] ..... A47C 17/22

[52] U.S. Cl. ..... 5/14; 5/59.1

[58] Field of Search ..... 5/12, 13, 14, 28, 59.1

[56] References Cited

U.S. PATENT DOCUMENTS 1,856,449 5/1932 Young ..... 5/13
2,557,734 6/1951 Fox ..... 5/59.1 X
3,296,632 1/1967 Hoffman, Jr. ..... 5/13

FOREIGN PATENT DOCUMENTS 2495913 6/1982 France ..... 5/14
2513866 4/1983 France ..... 5/14

*Primary Examiner*—Michael F. Trettel
*Attorney, Agent, or Firm*—Melvin K. Silverman

[57] ABSTRACT

A convertible sofa bed system includes a sofa seat with a convertible sofa bed in which the seat is rotationally connected to the top of a front panel of the sofa. Prior to unfolding of the bed portion of the sofa bed system, the sofa seat may be rotated forwardly in the direction of the user so that, after the bed portion is unfolded, the sofa seat will be situated beneath the unfolded bed portion in an unobstructive position which will not interfere with normal use of the unfolded sofa bed. After the sofa bed has been used and folded back into the structure of the sofa, the sofa seat may be readily rotated upwardly and in the direction of the back of the sofa bed and into its normal position within the seat of the sofa structure.

5 Claims, 7 Drawing Sheets

CONVERTIBLE SOFA BED SYSTEM

REFERENCE TO RELATED APPLICATION

This case is a continuation in part of application Ser. No. 07/464,138, filed Jan. 16, 1990, entitled Modular Furniture System, now abandoned.

BACKGROUND OF THE INVENTION

This invention represents an improvement over the inventions of the above referenced related application as well as over my U.S. Pat. No. 4,932,720 in that there is provided herein a system by which the cushions of a sofa and convertible furniture of like class may be conveniently placed beneath the extended sofa bed without need to separately remove and store the sofa pillows before the sofa is converted into a bed and, conversely, to orient such cushions for replacement onto the sofa after the sofa bed has been converted back to the original sofa structure.

In view of the above, the instant invention, while a outgrowth of my modular furniture inventions as referenced above, is as well applicable to other furniture systems which employ one or another type of convertible sofa or sofa bed system.

SUMMARY OF THE INVENTION

The invention constitutes a furniture system in which the sofa seat or cushions in a convertible sofa bed system are, by means of a piano hinge or like means, rotationally connected to the top of the front panel of the sofa. Thereby, the sofa cushions prior to unfolding of the bed portion of the sofa bed system, may be rotated forwardly in the direction of the user so that, after the bed portion is unfolded, the sofa seat or cushions will be situated beneath the unfolded bed portion in an unobstructive position which will not interfere with normal use of the unfolded sofa bed. After the sofa bed has been used and folded back into the structure of the sofa, the sofa seat or cushions may be readily rotated upwardly and in the direction of the back structure of the sofa bed and into their normal position within the seat of the sofa structure.

It is, accordingly, an object of the present invention to provide a system usable with sofa beds of both modular and non-modular construction which will facilitate ease of placement of sofa seat cushions prior to use of the sofa bed and will facilitate re-placement of sofa cushions after use of the sofa bed.

It is another object of the invention to provide a sofa bed system which will effect a more easily usable sofa bed system.

It is a further object of the present invention to provide a sofa bed system particularly adapted for use in connection with particular types of modular furniture including, particularly, sofa coaches, sofa chairs and love seats.

The above and yet other objects and advantages of the present invention will become apparent from the hereinafter set forth Brief Description of the Drawings, Detailed Description of the Invention and Claims appended herewith.

DETAIL DESCRIPTION OF THE INVENTION

With reference to the instant invention, there is first described the embodiment thereof which relates directly to my inventive modular furniture systems as referred to in the Background of the Invention.

Figure 1:
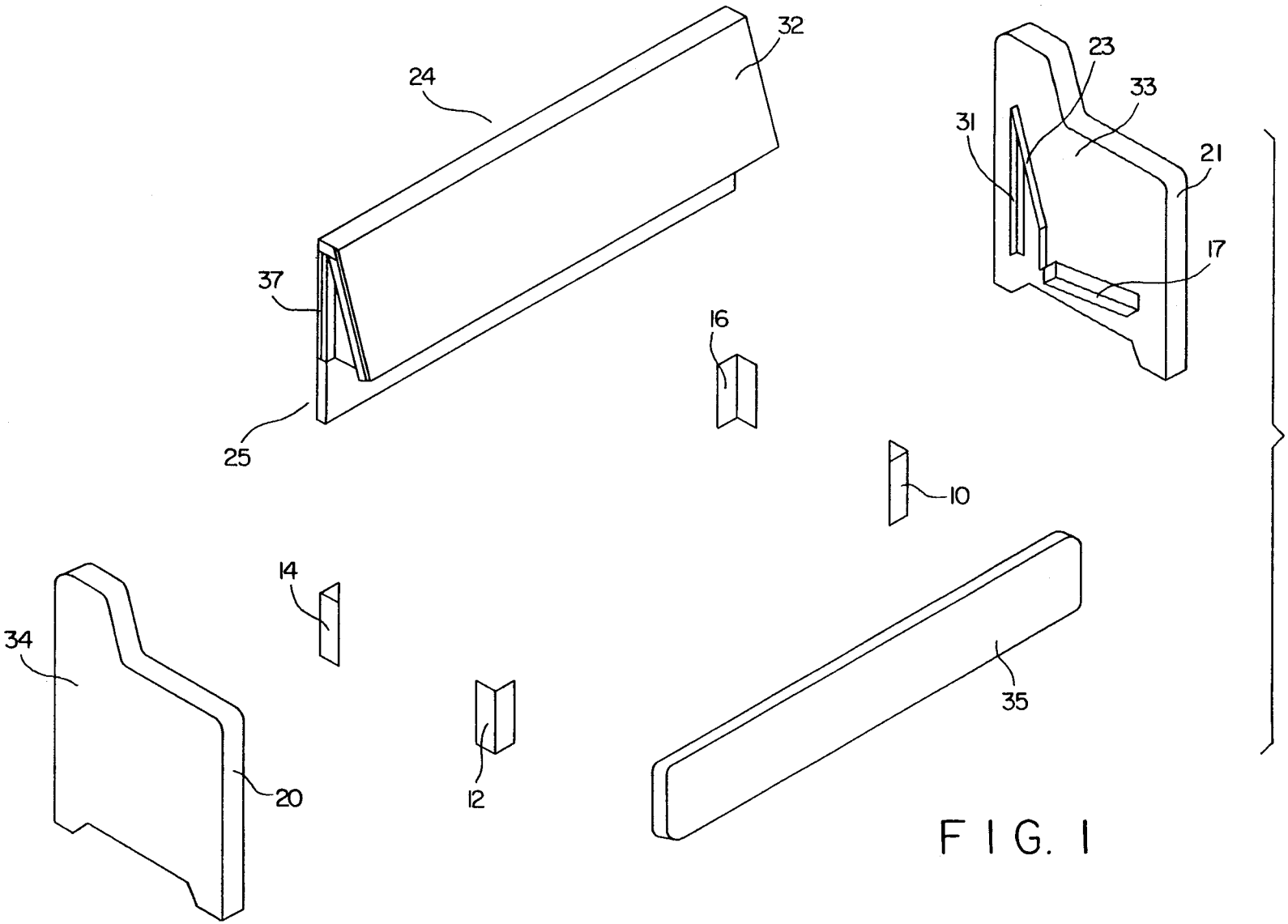
FIG. 1 is an exploded view of components of a modular sofa coach of a type with which the instant invention may be used.

With reference to the exploded view of FIG. 1, there is shown a left side panel 20 and a right side panel 21, each of which panels exhibits an inner side 33 and an outer side 34.

Figure 2:
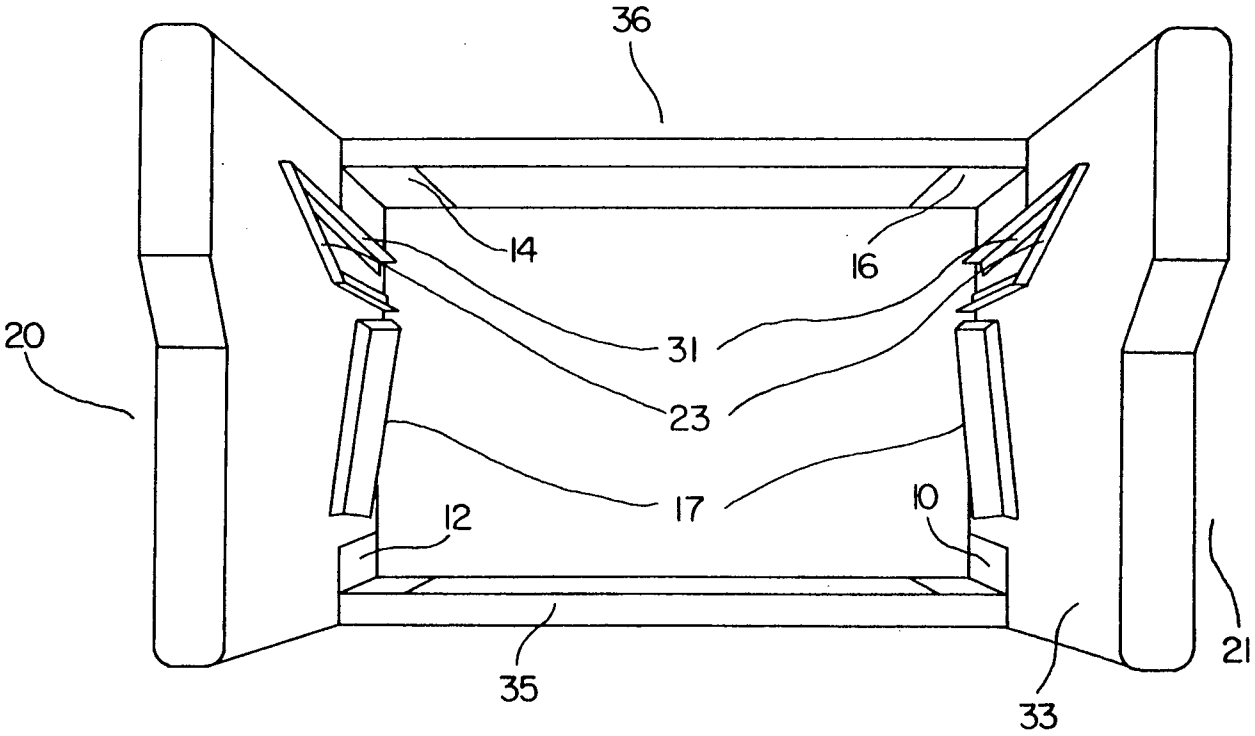
FIG. 2 is a top perspective view of an assembled modular coach employing the components shown in the view of FIG. 1.
Figure 4:
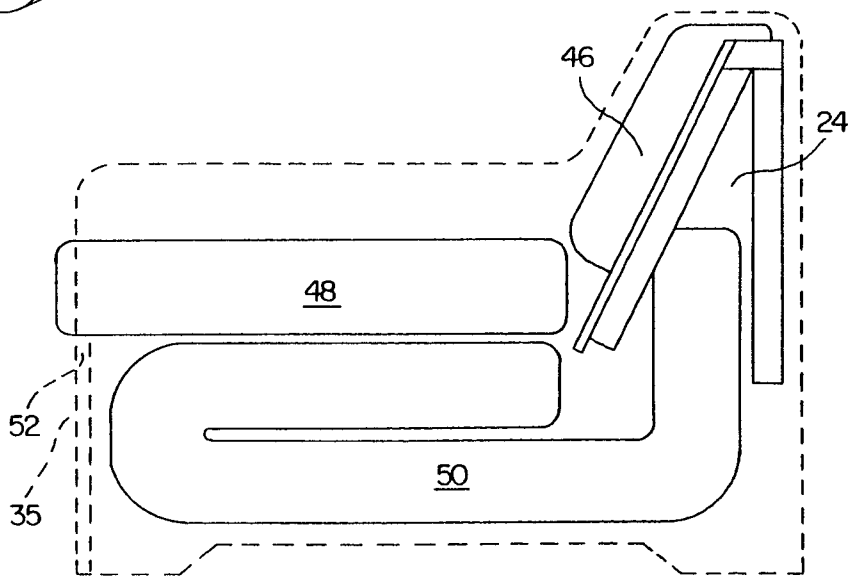
FIG. 4 is a side schematic view of the assembled modular system of FIGS. 1 thru 3 showing therein a convertible bed portion.

As may be noted with reference to the views of FIGS. 1, 2 and 4, each inner side 33 of the side panels is provided with a male engagement means defined by the combination of a vertical protruding element 31 and a diagonal protruding element 23. The overall effect of vertical element 31 and diagonal element 23 is to produce a substantially triangular railing which is proportioned to complemental detachably engage recessed transverse edge surface 22 of a hollow back module 24. See FIGS. 3 and 4. It may, particularly be noted that when transverse edge surface 22 of back module 24 engages vertical element 31 and diagonal element 23 of the side panel, the back module is maintained at a particular angulation and height relative to the floor.

When one wishes to remove the back module from the system, it is simply lifted upwardly and off of said elements 23 and 31, and a new or replacement back module is slipped onto said elements. Accordingly, it may be appreciated that both the assembly and disassembly of the system shown in FIGS. 1 thru 4 is accomplished without need for securement or locking means of any type.

The structure of back module 24 also includes a diagonal front surface 32 and a vertical back surface 37. See FIGS. 1 and 3. Further, a front panel 35 and a rear panel 36 are employed, which are secured between said left and right side panels 20 and 21 respectively by right angle metal brackets 10, 12, 14 and 16. See FIG. 2.

With further reference to the views of FIGS. 1 and 2, it may be noted that said side panels 20 and 21 are also provided with linear guide means 17 which are in the nature of an elongate angle brackets which increase in elevation relative to the floor from the rear of side panels to the front thereof, terminating at the rear just prior to the location of diagonal element 23 of said male engagement means. The purpose of said guide means 17 is to hold and engage a base 44 of removeable seat means 48. Accordingly, seat means 48, as with back module 24, may be positioned and removed without the need for securement elements of any kind.

Figure 3:
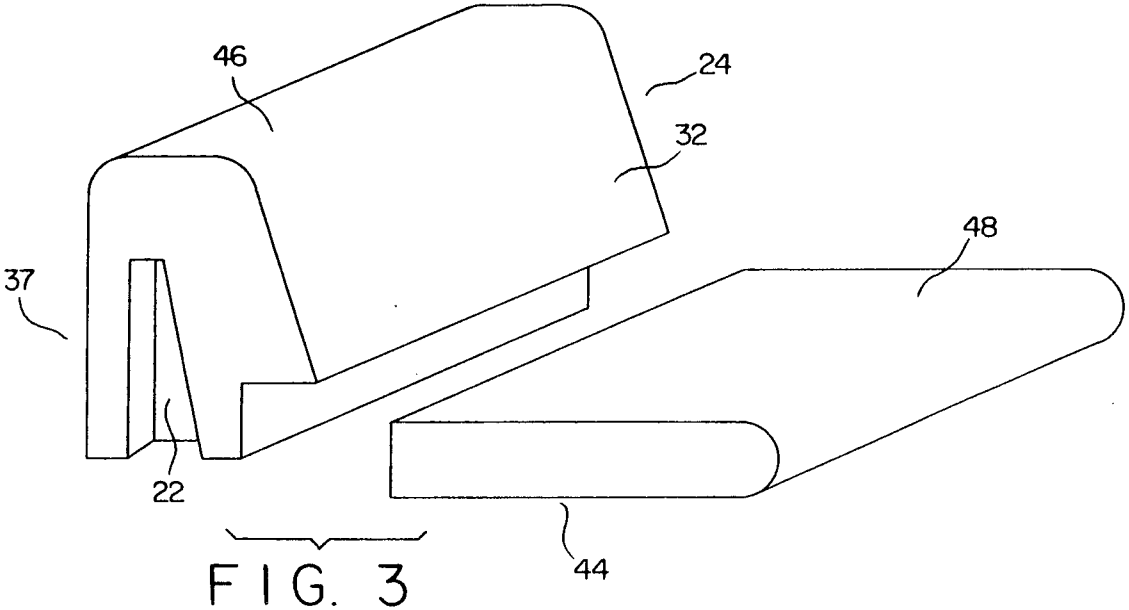
FIG. 3 is a perspective view of a back module and seat module of a type which may be used with a modular furniture system related to the type of sofa shown in the views of FIGS. 1 and 2.

As may be further noted with reference to the views of FIGS. 3 and 4, said back module and seat means are proportioned for complemental engagement with each other when the system is assembled. It is however to be appreciated that the instant invention is not limited in scope to such complementally engaging seat and back means.

By virtue of the above, there is defined a basic sofa system, consisting of side panels 21 and 22, front panel 35, back module 24 and seat means 48. Employing said components, a number of different furniture types, including a sofa, sofa bed, love seat, love seat bed, sofa chair, and sofa chair be may be easily assembled and, as desired, disassembled for purposes of changing and/or replacing either the back of the seat module or the fabric associated with either of said modules.

Figure 5:
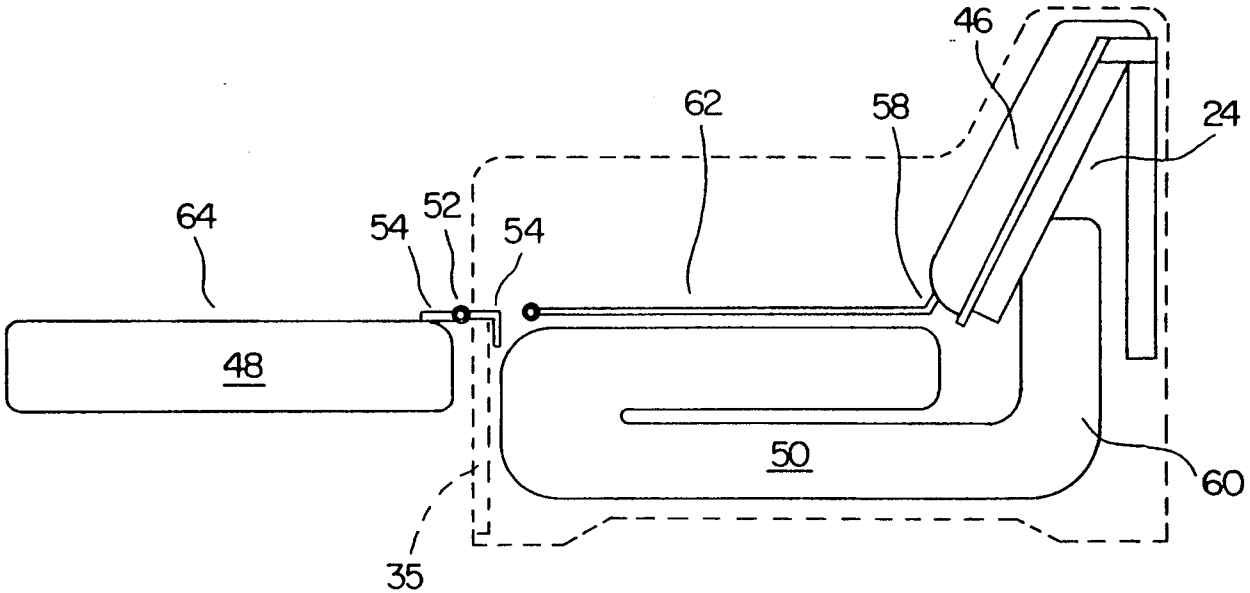
FIG. 5 is a side view, similar to the view of FIG. 4, however, showing the hinge means connection between the sofa seat and the front panel thereof.
Figure 6:
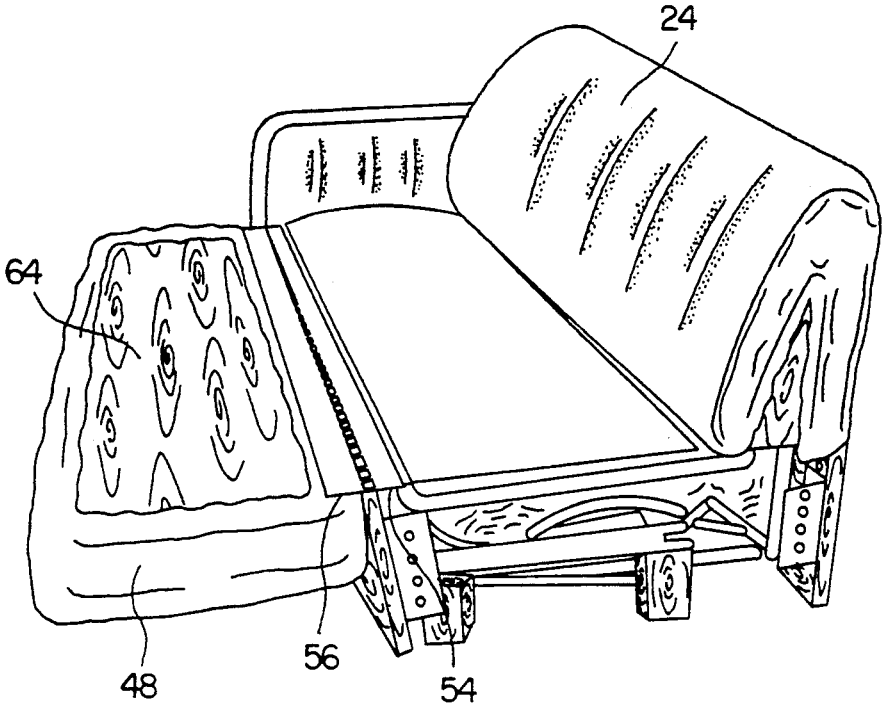
FIG. 6 is a perspective view, generally similar to the view of FIG. 5, in which the side panel of the system is removed to show the mechanism of the convertible bed portion of the system.

With particular reference to the present inventive system, as applied to the above described furniture system, it is noted, with reference to FIGS. 4 thru 6, that front panel 35 at the top thereof, is provided with hinge means 52, Once the elements of the hinge means, namely, element 54 is fixed to the upper portion of said front panel 35, and the other fixed element thereof, namely, element 56 is secured to a rigid bottom surface 64 of seat means 48, the seat means may readily be rotated outwardly. That is, through the use of hinge means 52, seat means 48 may readily be rotated forward as is shown in the views of FIGS. 5 and 6.

Figure 7:
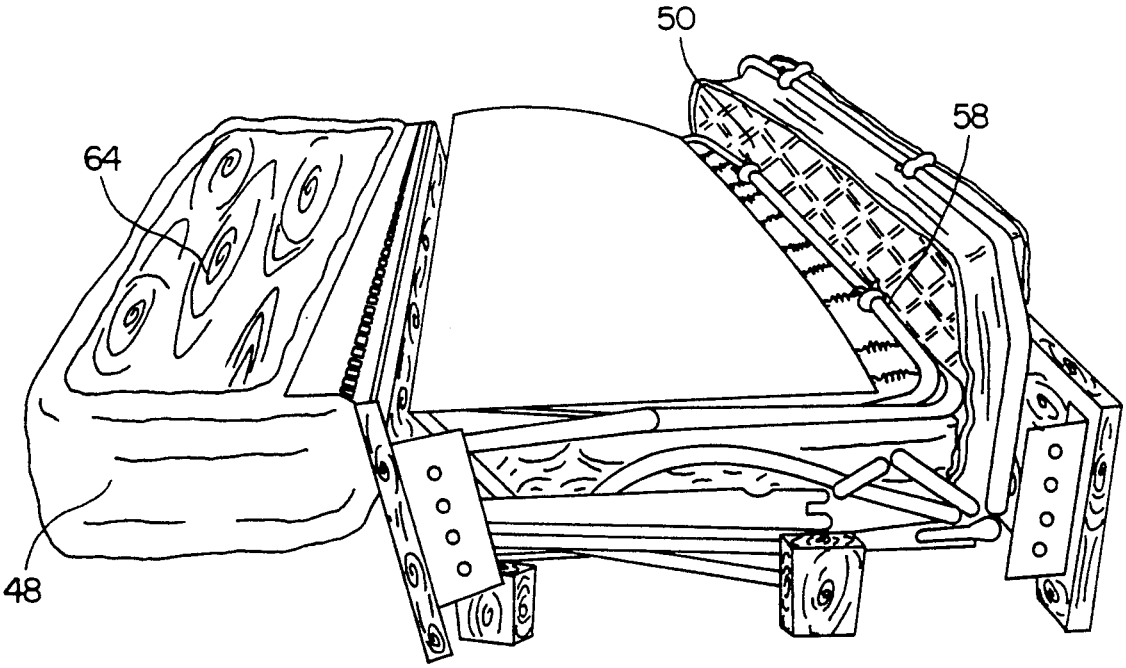
FIG. 7 is a side perspective view, similar to the view of FIG. 6, however, showing both the arm and back modules removed from the frame of the system.
Figure 8:
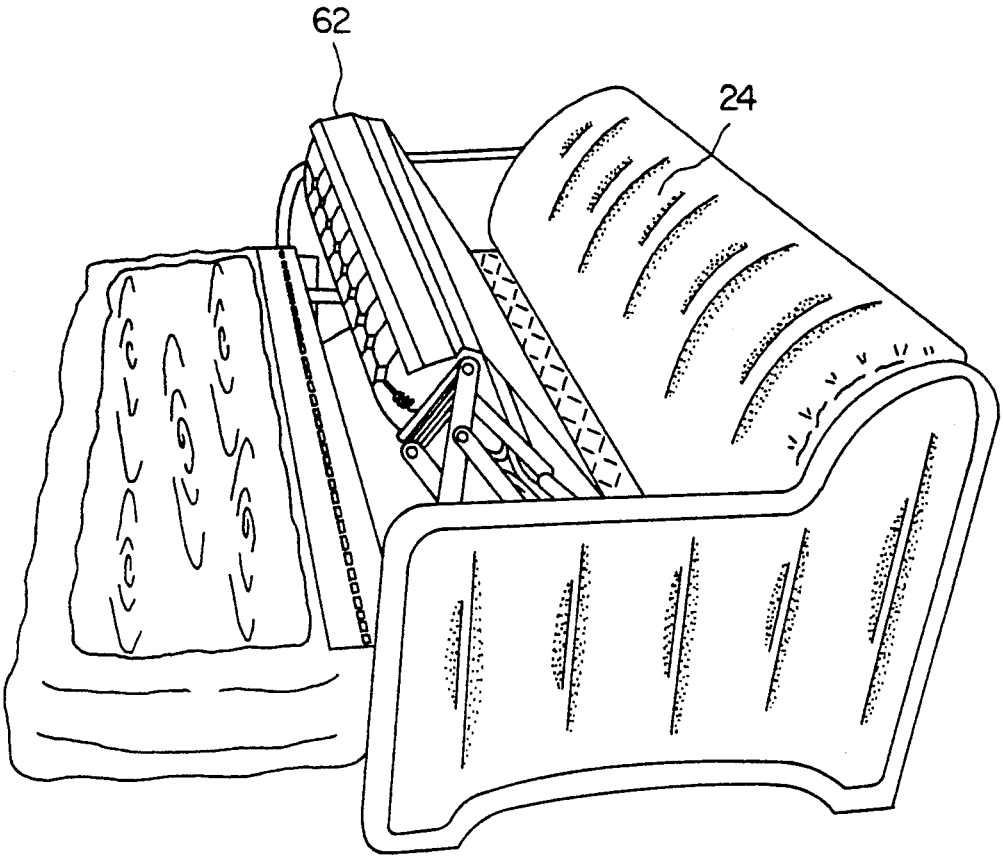
FIG. 8 is a perspective view, similar to the views of FIGS. 5, 6 and 7, however, showing a further step in the sequence of removal of the bed portion of the system from the sofa portion.
Figure 9:
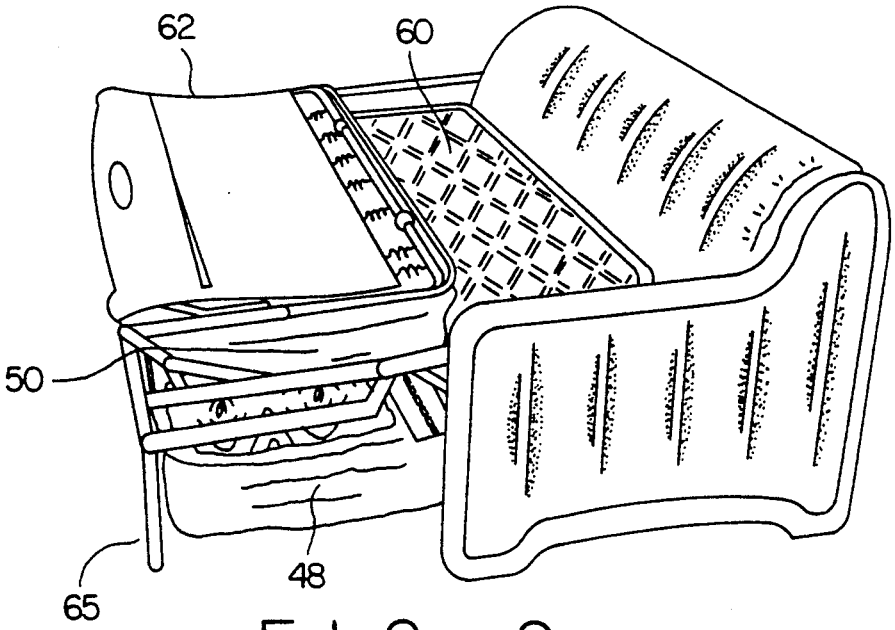
FIG. 9 is a perspective view, similar to the view of FIG. 8, however, showing a yet further step in the sequence of removal of the bed portion of the system from the sofa portion in which, particularly, the bed portion is located over and covering most of the sofa seat.

After seat means 48 has been rotated into its "storage" position, the convertible bed portion 50 of the system becomes visible. See FIG. 7 in which the side panel and back module have been removed. When convertible frame bar 58 of the convertible bed portion is pulled forward, a forward portion 60 of bed portion 50 (see FIGS. 5 and 7) will be pulled forward together with the rest of the convertible bed assembly. See FIGS. 8 and 9. Thereby, said forward portion 60 will become visible as is shown in FIG. 9 and, as well, a support portion 62 of bed portion 50 will unfold thereby covering seat means 48 such that the seat means is visible only from the side view. See FIGS. 9 and 10.

Integral to the present invention is the discovery that cushion 48 may be hinged in the fashion such that leg 65 of middle bed portion 62 will clear seat means 48 such that, after leg 65 has reach the floor, said seat means 48 will be snuggly positioned beneath the bed portion 50.

Figure 10:
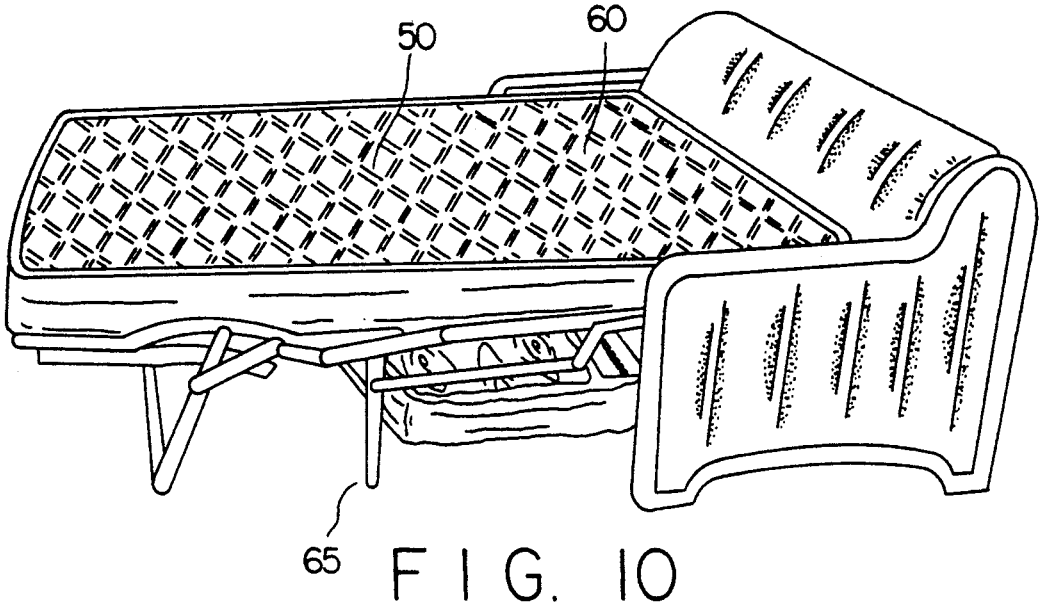
FIG. 10 is a further view in the sequence of steps of opening the bed portion of the sofa and, particularly, showing the sofa bed fully unfolded.

In FIG. 10, is shown the last step in the opening of bed portion 50. As may be noted, no further movement or contact of the convertible bed relative to the hinged sofa cushion occurs in this step.

When the bed is folded back into the sofa structure, the steps of FIGS. 4 thru 10 are repeated, however, in reverse. Thereby, after the sofa bed has been fully restored to its position within the sofa structure (see FIG. 7), the seat means 48 is rotated toward back module 24 such that the condition shown in FIG. 4 is again attained.

Figure 11:
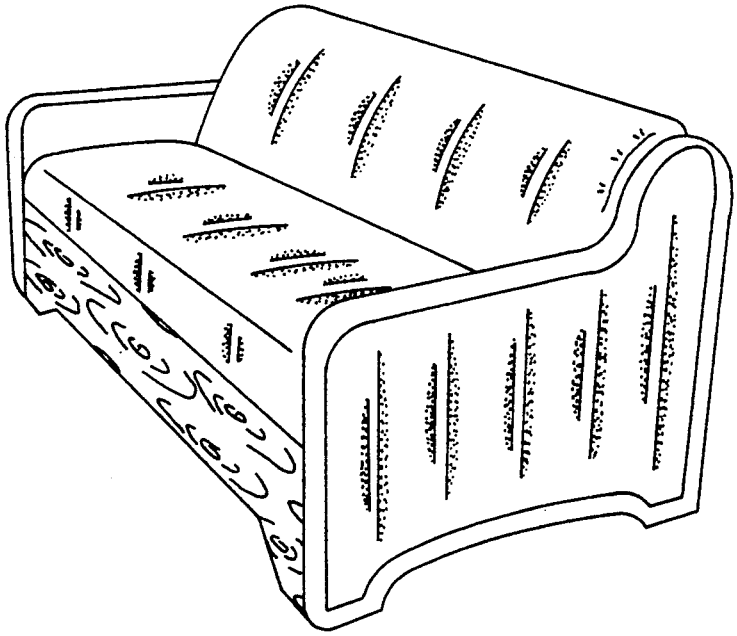
FIG. 11 is a perspective view showing the appearance of the sofa bed system when fully assembled and when in normal use as a sofa.

A perspective view of the entire system when assembled is shown in FIG. 11. Thereby, it may be appreciated that from all outward appearances, the entire system appears as a typical sofa. Neither the sofa bed aspect or the hinged seat feature is perceptible when the inventive sofa/sofa bed is in normal use as a sofa. In particular, the element 54 of hinge 52 may readily be covered with any of a number of finishes or fabrics such that its appearance cannot be noticed.

It is, within the scope of the present invention, to be understood that the invention is equally applicable where the seat of the sofa, love seat, sofa chair or other furniture to which the present invention utilized more than a single cushion. Suitable hinge means may simply be applied to the bottom of each and every cushion. It is, therefore, to be appreciated that the instant invention may be practiced with respect to any type of cushion of any sofa, love seat, or sofa seat, which possesses a sufficiently rigid bottom surface 64 (see FIGS. 5, 6 and 7) such that element 56 of hinge means 52 may be secured thereto. In other words, the instant invention is not applicable to furniture systems in which the sofa pillows are soft on all of the bottom thereof.

It is to be further appreciated that the instant invention may equally as well be applied to furniture systems which are not modular so long as there exists the above reference rigid lower surface associated with the seat of the system. Accordingly, it is to be understood that the instant invention is applicable to any sofa bed, love seat bed, sofa chair bed system in which it is feasible to provide the cushions thereof with a rigid surface which can be attached to a piano hinge or like means. In connection therewith it is to be understood that the views of FIGS. 4 and 5 illustrate a structure which is representative both of such prior are conventional convertible bed systems and modular type convertible bed systems.

While there has been shown and describe the preferred embodiment of the present invention, it may be appreciated that the invention may be embodied than is herein specifically shown and described and that within said embodiment certain changes may be made within the form and arrangement of the parts with departing from the underlying principles of this invention as set forth in the Claims appended herewith.

I claim:

1. A convertible sofa bed system, comprising:

(a) a sofa structure including a back section, side panels, and a rigid front panel;

(b) seat means removably placed within said sofa structure between said side panels and above said front panel, said seat means including a rigid bottom surface;

(c) fixed hinge means having rotationally related first and second surfaces, said first surface secured to an upper edge of said front panel and said second surface secured to said rigid bottom surface of said seat means; and (d) a convertible sofa bed and sofa bed mechanism positioned within said sofa structure for selectable extension over said seat means after said seat means has been rotated away from said sofa structure, whereby said sofa bed and mechanism may be opened and closed without requirement to store or retrieve said seat means respectively before and after use of the bed system.

2. The system as recited in claim 1 in which said seat means comprises a cushion seat.

3. The system as recited in claim 1 in which said seat means comprises a plurality of cushions.

4. The system as recited in claim 1 in which said sofa structure comprises a sofa chair.

5. The system as recited in claim 1 in which said sofa structure comprises a love seat.

* * * * *